US008087333B2

(12) United States Patent
Oishi

(10) Patent No.: US 8,087,333 B2
(45) Date of Patent: Jan. 3, 2012

(54) METHOD FOR PRESS PUNCHING A HOLE IN SHEET METAL AND PRESS DIE

(75) Inventor: Masatoshi Oishi, Hiroshima (JP)

(73) Assignees: Ones Co., Ltd., Saeki-Gun, Hiroshima (JP); Oiles Corporation, Minato-Ku, Tokyo (JP)

( * ) Notice: Subject to any disclaimer, the term of this patent is extended or adjusted under 35 U.S.C. 154(b) by 0 days.

(21) Appl. No.: 10/320,708

(22) Filed: Dec. 17, 2002

(65) Prior Publication Data

US 2004/0112188 A1 Jun. 17, 2004

(51) Int. Cl.
*B26F 1/14* (2006.01)

(52) U.S. Cl. ..... 83/140; 83/138; 83/145; 83/549; 83/686

(58) Field of Classification Search ..... 83/588, 83/636, 679, 694, 684, 686, 688, 622, 687, 83/621, 691, 695, 552, 549, 685, 129–130, 83/136, 138, 140, 143, 145
See application file for complete search history.

(56) References Cited

U.S. PATENT DOCUMENTS

| | | | | | |
|---|---|---|---|---|---|
| 229,840 | A | * | 7/1880 | Richards | 83/686 |
| 434,738 | A | * | 8/1890 | Tennant | 83/686 |
| 770,238 | A | * | 9/1904 | Lovejoy | 83/686 |
| 904,714 | A | * | 11/1908 | McGrath | 83/686 |
| 1,070,889 | A | * | 8/1913 | Hartog | 76/107.1 |
| 1,166,613 | A | * | 1/1916 | Mackle | 83/686 |
| 1,179,476 | A | * | 4/1916 | Thomas | 279/44 |
| 1,533,236 | A | * | 4/1925 | Dawson | 148/566 |
| 1,545,029 | A | * | 7/1925 | Bechtold | 83/490 |
| 1,569,136 | A | * | 1/1926 | Pardee, Jr. | 83/687 |
| 1,723,935 | A | * | 8/1929 | Henricson | 83/140 |
| 1,822,468 | A | * | 9/1931 | Wales | 83/140 |
| 2,268,787 | A | * | 1/1942 | Wales | 83/140 |
| 2,540,852 | A | * | 2/1951 | Wilcox | 470/25 |
| 2,562,267 | A | * | 7/1951 | Granberg | 83/138 |
| 2,730,811 | A | * | 1/1956 | Gouldsmith, Jr. | 33/677 |
| 2,798,553 | A | * | 7/1957 | Berdan | 83/684 |
| 2,928,451 | A | * | 3/1960 | Taylor | 72/328 |
| 3,079,824 | A | * | 3/1963 | Schott | 83/140 |
| 3,114,280 | A | * | 12/1963 | Schott | 83/140 |
| 3,122,044 | A | * | 2/1964 | Grosh | 83/588 |
| 3,125,917 | A | * | 3/1964 | Smeets | 83/140 |
| 3,136,195 | A | * | 6/1964 | Jacobsen et al. | 83/466.1 |
| 3,465,634 | A | * | 9/1969 | Blais | 83/695 |
| 3,673,901 | A | * | 7/1972 | Vinson | 83/14 |
| 3,871,254 | A | * | 3/1975 | Whistler et al. | 83/139 |
| 4,166,403 | A | * | 9/1979 | DiDonato et al. | 83/13 |
| 4,229,874 | A | * | 10/1980 | Schultz et al. | 29/432 |
| 4,248,545 | A | * | 2/1981 | Andersen | 403/227 |

(Continued)

FOREIGN PATENT DOCUMENTS

JP 11-129041 5/1999

*Primary Examiner* — Edward Landrum
(74) *Attorney, Agent, or Firm* — Nixon & Vanderhye PC

(57) ABSTRACT

A punch unit for a press die is provided for punching a hole in sheet metal. The punch unit includes a piercing punch provided with a sharp projection, a plunger for pressing the piercing punch, a cylinder for supporting the piercing punch and the plunger slidably in a punching direction, and a coil spring for retracting the piercing punch and the plunger. Also disclosed is a press die for punching a hole in sheet metal using the punch unit.

6 Claims, 3 Drawing Sheets

U.S. PATENT DOCUMENTS 4,306,356 A * 12/1981 Buscher et al. ..... 30/362
4,526,077 A * 7/1985 DeGuvera ..... 83/686
4,545,272 A * 10/1985 Herb ..... 83/165
4,947,718 A * 8/1990 Whistler ..... 83/138
5,054,347 A * 10/1991 Johnson et al. ..... 83/140
5,072,518 A * 12/1991 Scott ..... 29/798
5,144,872 A * 9/1992 Kakimoto ..... 83/13
5,931,074 A * 8/1999 Matsuoka ..... 83/588

* cited by examiner

METHOD FOR PRESS PUNCHING A HOLE IN SHEET METAL AND PRESS DIE

BACKGROUND OF THE INVENTION

1. Field of the Invention

The present invention relates to a method for punching a hole in a sheet metal by press working and a press die.

2. Description of the Related Art

Conventionally, in a case where a hole is punched in a sheet metal by press working, it is the general practice to place a workpiece on a piercing die having a punching hole and subsequently to lower an upper die having a piercing punch so as to effect shearing work with respect to the workpiece by the punch and the die.

In the case where work is effected using such a conventional technique, it is normally necessary to control the clearance between the piercing punch and the piercing die to within plus 0.01 millimeter and minus 0.01 millimeter. If this clearance cannot be maintained, burrs can occur in the workpiece, or defects of punching edges of the piercing punch and the piercing die or the breakage of the piercing punch can occur owing to the interference between the piercing punch and the piercing die.

To prevent this problem from occurring, large cost of die fabrication and long periods of die design and fabrication are conventionally required, involving such as the planning of a die structure which makes it possible to ensure the axial accuracy of the piercing punch and the piercing die with high accuracy as well as manual operations for enhancing the die fabrication accuracy.

In addition, in a case where a hole is punched in a plate surface which is inclined with respect to the press working direction, since the piercing punch tends to escape in the direction of inclination to make it impossible to maintain the clearance, and since the breakage of the punch occurs, a slide cam mechanism is conventionally provided, and the punch is held by this slide cam mechanism to force out the punch in a direction different from the pressing direction.

Conventionally, as the aforementioned slide cam mechanism, if broadly classified, two structures have been devised.

One is a structure to hold a cam slider by a pad incorporated in an upper die holder, and this structure is effective to simplify the die structure. However, since this pad is held on the workpiece placed on the lower die, variation can occur in the position where the pad is held with respect to the lower die because of the variation of configurations of workpieces.

For this reason, this structure is not used since it is difficult to maintain the clearance between the piercing punch and the die necessary for the conventional punching method.

Accordingly, another slide cam mechanism is conventionally used in which a cam slider is mounted on the upper die holder or the lower die.

However, with this other slide cam mechanism, since not only is this cam mechanism itself expensive, but a multiplicity of dies are required for manufacturing a single pressed part, since it is impossible to effect the simultaneous cutting work of outer peripheral edges of a pressed part and the simultaneous piercing work of a plurality of different surfaces.

In addition, in the process of manufacturing pressed parts, there is a problem in that large repairing cost is involved for maintaining the axial accuracy of the piercing punch and the piercing die.

JP-A-11-129041 discloses a press die in which, instead of the piercing punch, a pressure medium typified by urethane rubber is pressed to punch a hole in a workpiece, to solve the above problems.

In the press die disclosed in that document, tension is applied to the workpiece at the hole portion of the piercing die buried in the lower die by means of the pressure applied to the pressure medium, and the workpiece is thereby fractured by an outer peripheral edge portion of the hole portion of the die so as to obtain a hole.

However, in the case where pressing is effected by the press die disclosed in that document, after the workpiece has been fractured by a portion of the outer periphery of the hole portion of the piercing die, the pressure applied to the pressure medium escapes to the fractured space, and the pressure medium is released. Therefore, even if further pressurization is effected, it is impossible to transmit tension for punching a hole in the workpiece, with the result that it is impossible to fracture over the entire region of the outer periphery of the hole portion of the piercing die, making it impossible to obtain a satisfactory hole configuration. In addition, there is another problem in that the pressure medium typified by urethane rubber is shaved off by the sharp edge portion of the piercing die hole, so that the pressure medium lacks durability.

SUMMARY OF THE INVENTION

The present invention has been devised in view of the above-described circumstances, and its object is to provide a punch unit which allows a certain degree of axial offset between the piercing punch and the piercing die, permits high-quality punching reliably without using a complex slide cam mechanism, improves durability over the conventional art, and thereby makes it possible to lower the die fabrication cost, shorten the period of die fabrication, and reduce the die repairing cost, as well as a press die and a punching method using this punch unit.

To this end, in accordance with a first aspect of the present invention there is provided a punch unit for a press die for punching a hole in sheet metal, comprising: a piercing punch provided with a sharp projection; a plunger for pressing the piercing punch; a cylinder for supporting the piercing punch and the plunger slidably in a punching direction; and a coil spring for retracting the piercing punch and the plunger.

In the above-described punch unit, preferably, the sharp projection is provided on a surface opposing a piercing die buried in a lower die, the cylinder is adapted to be fitted in a pad of an upper die, and an outer peripheral edge portion of a tip of the piercing punch provided with the sharp projection is rounded.

In addition, in accordance with a second aspect of the present invention there is provided a press die for punching a hole in sheet metal, comprising: an upper die having a pad; a lower die in which a piercing die is buried; a cylinder fitted in the pad; a piercing punch supported slidably in a punching direction by the cylinder and disposed in face-to-face relation to the piercing die; a plunger for pressing a head of the piercing punch, the plunger being supported slidably in the punching direction by the cylinder; and a coil spring disposed in the cylinder to retract the piercing punch and the plunger, the plunger having a head pressed by one of an upper die holder and a plate secured to the upper die holder so as to force out the piercing punch.

In the press die for punching a hole in the present invention, the piercing die may be buried in an inclined surface of the lower die.

In addition, in accordance with a third aspect of the present invention there is provided a method for press punching a hole in sheet metal, comprising the steps of: causing a workpiece to be pressed by a piercing punch which is held by an upper die and which has a smaller diameter than in a case where it is used in shearing work with respect to a diameter of a hole of a piercing die buried in a lower die, and has at a tip thereof at least one sharp projection for piercing the workpiece, an outer peripheral edge portion of the tip where the sharp projection is provided being rounded, so as to punch a pierced hole in the workpiece by the sharp projection; and further pressing the piercing punch in a state in which the lateral movement of the workpiece in a hole portion of the piercing die is restricted by the sharp projection and the pierced hole, so as to fracture the workpiece by a peripheral edge portion of the hole portion of the piercing die, thereby forming in the workpiece a hole having substantially the same configuration as that of the hole of the piercing die.

The above-described method preferably further comprises the step of: forming a hole in a plate surface of the workpiece having an inclination with respect to a direction in which the workpiece is pressed.

In accordance with the present invention, the planning of a complex die structure for ensuring the axial accuracy of the piercing punch and the piercing die and manual operations for enhancing the die fabrication accuracy become unnecessary. Thus it is possible to reduce the number of die fabrication steps and shorten periods of die design and fabrication.

In addition, in accordance with the present invention, it is unnecessary to use a complex and expensive slide cam structure in a case where punching work is effected with respect to a plate surface of a workpiece which is inclined with respect to the pressing direction. Since the fabrication cost associated with the slide cam and the operation of aligning the piercing punch and the piercing die are not required, it is possible to reduce the die fabrication cost and shorten the period of die fabrication.

Furthermore, in accordance with the present invention, since the slide cam structure which is mounted on the upper die holder or the lower die is unnecessary, it is possible to simultaneously effect punching in a plurality of different plate surfaces of the workpiece, and the peripheral edge cutting work and punching work can be effected simultaneously. Therefore, the number of press working steps can be reduced substantially, and the number of dies can be decreased, so that it is possible to lower the die cost and shorten the periods of die design and fabrication.

In addition, in accordance with the present invention, it is possible to reduce the repairing cost for correcting axial offset between the piercing punch and the piercing die occurring due to the wear of slide surfaces of upper and lower dies and cam slide surfaces at the time of mass production.

Hereafter, a description will be given of the present invention with reference to the embodiments shown in the drawings. It should be noted that the present invention is not limited to these embodiments.

DESCRIPTION OF THE PREFERRED EMBODIMENTS

Figure 1:
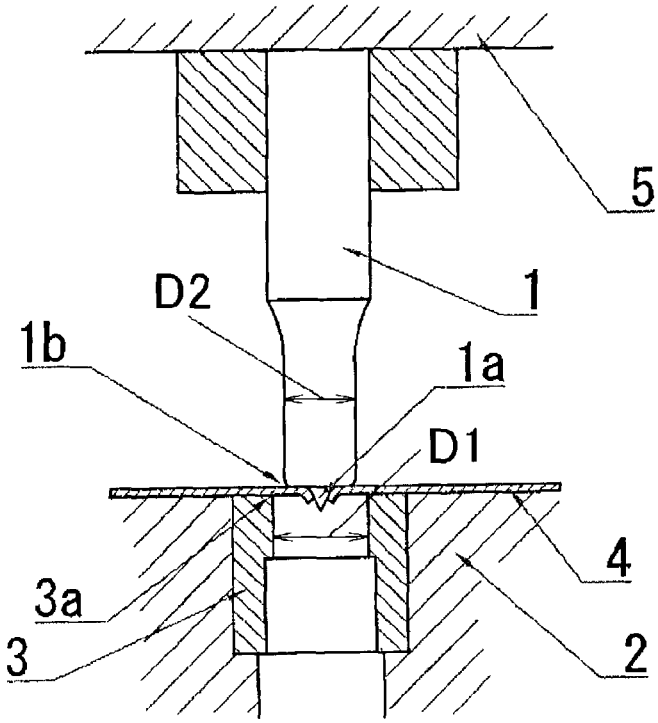
FIG. 1 is a cross-sectional view illustrating an embodiment of a punching method.
Figure 2:
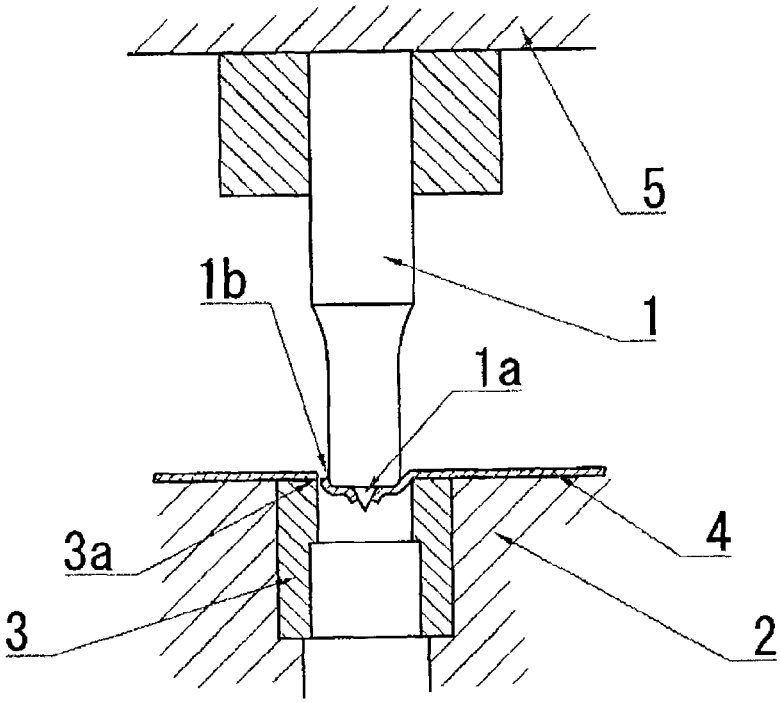
FIG. 2 is a cross-sectional view illustrating the embodiment of the punching method.
Figure 3:
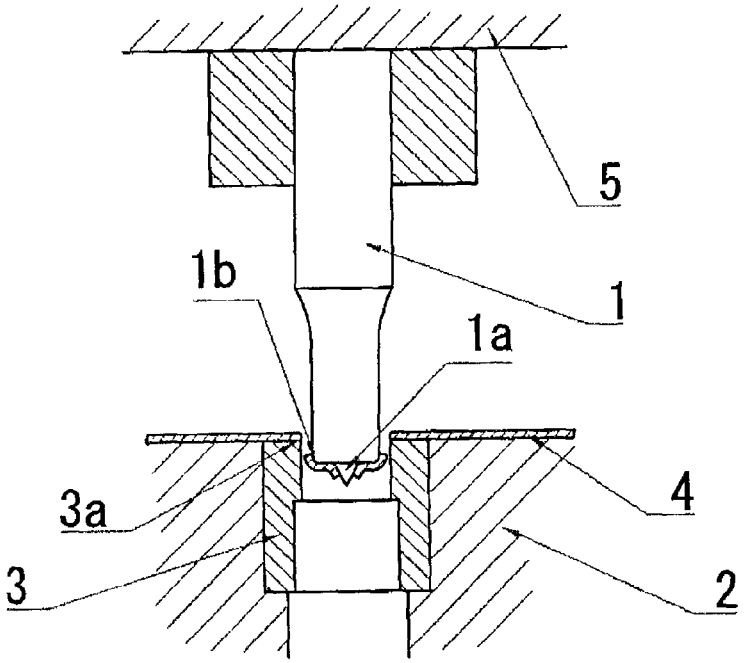
FIG. 3 is a cross-sectional view illustrating the embodiment of the punching method.

In FIGS. 1 to 3, a press die for punching is comprised of a piercing die 3 buried in a lower die 2 as well as a piercing punch 1 held by an upper die 5. The piercing punch 1 has a smaller diameter D2 than in a case where it is used in shearing work with respect to a diameter D1 of the hole of the piercing die 3, and the piercing punch 1 has at its tip a sharp projection 1*a* for piercing a workpiece 4. In such a piercing punch 1, an outer peripheral edge portion 1*b* of the tip where the sharp projection 1*a* is provided is rounded.

In a case where punching is effected by the press die for punching shown in FIGS. 1 to 3, the workpiece 4 formed of sheet metal is placed on the lower die 2 including the piercing die 3, and as the upper die 5 is lowered, the piercing punch 1 is pressed against the workpiece 4. Thus, as shown in FIG. 1, in the initial period of working, the sharp projection 1*a* provided on the piercing punch 1 is first brought into contact with the workpiece 4, thereby forming a pierced hole in the workpiece 4 by the sharp projection 1*a* of the piercing punch 1. Further, as shown in FIG. 2, as the upper die 5 is further lowered, the piercing punch 1 is pressed into the piercing die 3, thereby causing the rounded edge portion 1*b* of the piercing punch 1 to come into contact with the workpiece 4. At the same time, in a state in which the lateral movement of the workpiece 4 in the hole portion of the piercing die 3 is restricted by the sharp projection 1*a* and the pierced hole, tension is applied to a portion of the workpiece 4 corresponding to the hole portion of the piercing die 3. Then, the piercing punch 1 is further pressed to bring the workpiece 4 to a limit of fracture, and a portion of the workpiece 4 is thereby fractured by an outer peripheral edge portion 3*a* of the hole portion of the piercing die 3.

At this time, the tension imparted to the workpiece 4 would be normally released, but in the present invention the tension imparted to the workpiece 4 is held by the sharp projection 1*a* provided on the piercing punch 1 and the pierced hole punched in the initial period of working.

As shown in FIG. 3, as the upper die 5 is further lowered, the piercing punch 1 is further pressed into the piercing die 3, the workpiece 4 is fractured by the entire periphery of the inner peripheral edge portion 3*a* of the hole portion of the piercing die 3, with the result that a hole having substantially the same configuration as that of the hole of the piercing die 3 is formed in the workpiece 4.

Figure 4:
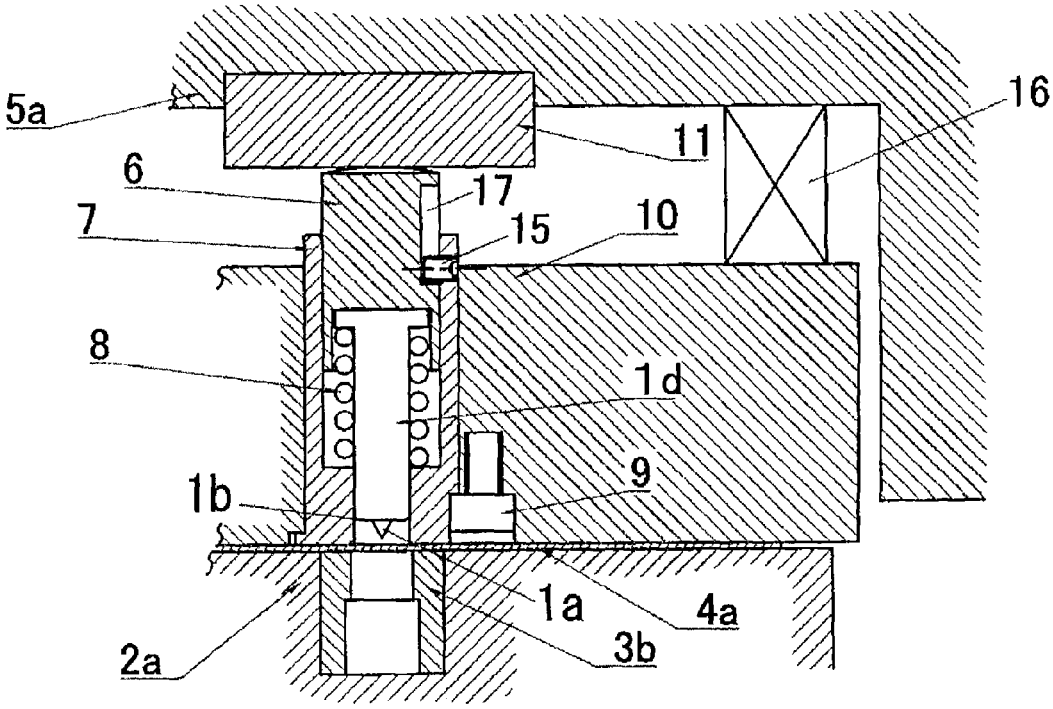
FIG. 4 is a cross-sectional view illustrating a press die for punching.

A press die in accordance with another embodiment shown in FIG. 4 is comprised of: a punch unit including a piercing punch 1*d* which is disposed in face-to-face relation to a piercing die 3*b* buried in a lower die 2*a* and is provided with the sharp projection 1*a*, a plunger 6 for pressing the piercing punch 1*d*, a cylinder 7 for supporting the piercing punch 1*d* and the plunger 6 slidably in the punching direction, a coil spring 8 for retracting or pressing back the piercing punch 1*d* and the plunger 6, and a stopper 15 for prohibiting the pressing back of the piercing punch 1*d* and the plunger 6 by the coil spring 8 by more than a fixed length; a bolt 9 for fixing the cylinder 7 as fitted in a pad 10; and a plate 11 fixed to an upper die holder 5*a* for the purpose of pressing the plunger 6.

The sharp projection 1*a* is provided on the surface of the piercing punch 1*d* opposing the piercing die 3*b*, and the outer peripheral edge portion 1*b* of the tip of the piercing punch 1*d* provided with the sharp projection 1*a* is rounded. The upper die includes the upper die holder 5*a*, the pad 10, the plate 11, and a resilient member 16. The pad 10 is connected to the upper die holder 5*a* with the resilient member 16 interposed therebetween. The stopper 15 is threadedly secured to the cylinder 7, and its one end portion faces an axial groove 17 provided in the plunger 6.

Accordingly, the press die for punching a hole in the sheet metal shown in FIG. 4 is arranged such that the piercing punch 1*d* opposing the piercing die 3*b* buried in the lower die 2*a* as well as the plunger 6 for pressing the head of the piercing punch 1*d* are supported slidably in the punching direction by the cylinder 7 fitted in the pad 10 of the upper die, the coil spring 8 for retracting the piercing punch 1*d* and the plunger 6 is provided in the cylinder 7, and the head of the plunger 6 is pressed by the plate 11 secured to the upper die holder 5*a* so as to force out the piercing punch 1*d*.

In the press die for punching a hole in the sheet metal shown in FIG. 4, the plate 11 may be omitted, and the piercing punch 1*d* may be forced out by directly pressing the head of the plunger 6 by the upper die holder 5*a*.

To describe the punching by the press die shown in FIG. 4, as the upper die holder 5*a* is lowered, the pad 10 is brought into contact with a workpiece 4*a* placed on the piercing die 3*b* of the lower die 2*a*, whereupon the pad 10 is held at that position by the lower die 2*a* with the workpiece 4*a* interposed therebetween. As the upper die holder 5*a* is further lowered, the plate 11 secured to the upper die holder 5*a* is brought into contact with the plunger 6, and as the upper die holder 5*a* is further lowered, the plunger 6 is pressed, and the piercing punch 1*d* is also pressed concurrently in a similar manner.

The piercing punch 1*d* and the plunger 6 are forced out while compressing a pressure source such as the coil spring 8 in a state of being guided by the cylinder 7, and a hole is punched in the workpiece 4*a*, as described above. After working, as the upper die holder 5*a* and the pad 10 are raised, the piercing punch 1*d* and the plunger 6 are returned to the state persisting prior to working by means of the pressure source such as the coil spring 8.

Figure 5:
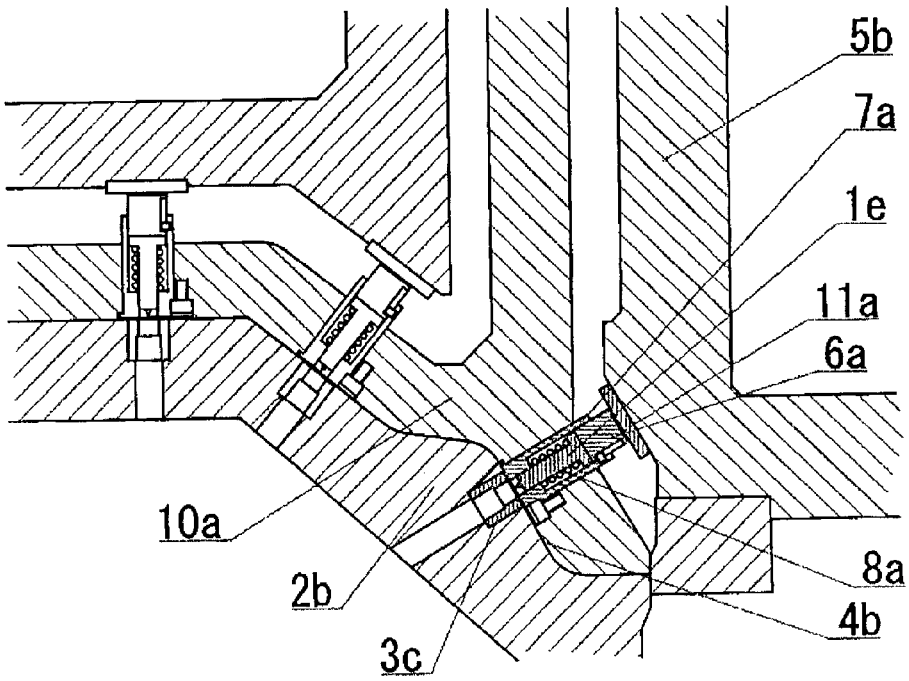
FIG. 5 is a cross-sectional view illustrating a press die for punching.
Figure 6:
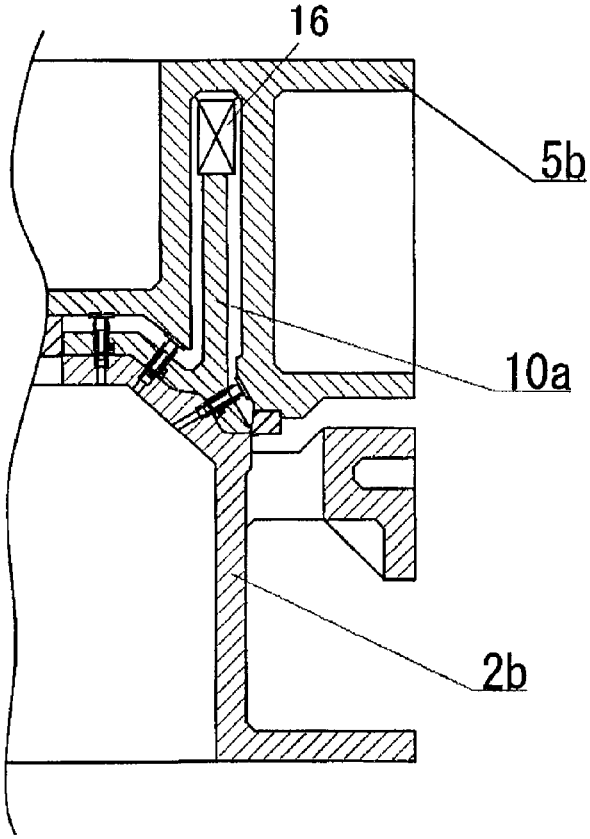
FIG. 6 is a cross-sectional view illustrating the entirety of FIG. 5.

As shown in FIGS. 5 and 6, in a press die for punching a hole in a plate surface of a workpiece 4*b* which is inclined with respect to the rising and lowering directions of an upper die holder 5*b* (pressing direction), a piercing die 3*c* is buried in an inclined surface of a lower die 2*b* in a direction perpendicular to that inclined surface. In addition, the above-described punch unit is fitted in a main body pad 10*a* in a direction in which the punch unit opposes the piercing die 3*c*.

As the upper die holder (press slide) 5*b* is lowered, after the pad 10*a* is first brought into contact with the workpiece 4*b* placed on the lower die 2*b*, the position of the pad 10*a* with respect to the lower die 2*b* is maintained although there is some variation. As the upper die holder 5*b* is further lowered, a plate 11*a* secured to the upper die holder 5*b* is brought into contact with a plunger 6*a*, whereupon the plunger 6*a* is guided and pressed in a direction perpendicular to the inclined surface by a cylinder 7*a*, and presses a piercing punch 1*e* concurrently. As the upper die holder 5*b* is further lowered, the piercing punch 1*e* and the plunger 6*a* are forced out while compressing a pressure source such as a coil spring 8*a*. At this time, since a hole is punched in the workpiece 4*b* in the same way as described above, even if variation occurs in the position of the pad 10*a* relative to the lower die 2*b*, a high-quality hole is punched. After working, as the upper die holder 5*b* and the pad 10*a* are raised, the piercing punch 1*e* and the plunger 6*a* are returned to the state persisting prior to working by means of the pressure source such as the coil spring 8*a*. In the above-described manner, a hole is formed in the plate surface of the workpiece 4*b* having an inclination relative to the direction in which the workpiece 4*b* is pressed.

What is claimed is:

1. A punch unit for a press die for punching a hole in sheet metal, comprising:

a piercing punch having a piercing punch body, a sharp projection provided on one end of the piercing punch body for first piercing the sheet metal on a piercing die with a hole in a punching operation of the punch unit to form a first pierced hole in the sheet metal, and a flange portion united with another end of the piercing punch body, said piercing punch body having an outer cylindrical surface extending in a punching direction, an end surface provided on said one end thereof opposing the piercing die buried in a lower die, and extending in a direction perpendicular to the punching direction, and a convexly rounded surface disposed between said outer cylindrical surface and an outer periphery of said end surface, said sharp projection projecting in the punching direction from an inner periphery of said end surface, said piercing punch body being adapted to pierce the sheet metal, in which said first pierced hole is already formed by said sharp projection, to form a second pierced hole in the sheet metal in said punching operation of the punch unit, said second pierced hole having substantially the same configuration as that of the hole of the piercing die;

a plunger for pressing said piercing punch, said plunger having a plunger body with one end surface which is adapted to be in contact with a plate secured to an upper die, a wall portion integrally provided on another end surface of the plunger body, and a hollow portion provided on the another end surface of the plunger body, said hollow portion being defined by the another end surface of the plunger body and an inner surface of the wall portion, being closed by the another end surface of the plunger body at an upper end portion thereof, and opening at a lower end portion thereof, said piercing punch is partially disposed in the hollow portion, said flange portion is disposed in the hollow portion so as to be brought into contact with the another end surface of said plunger body at an upper surface thereof, a cylinder adapted to be fitted in a pad of the upper die for supporting said piercing punch and said plunger slidably in a punching direction; said cylinder having a larger diameter hole portion in which said plunger is partially disposed, and a smaller diameter hole portion which is communicated with said larger diameter hole portion, and in which said piercing punch is partially disposed, and a step portion disposed between said larger hole portion and said smaller diameter hole portion, and a coil spring disposed between said flange portion of said piercing punch and said step portion of said cylinder for retracting said piercing punch and said plunger, said piercing punch being slidably disposed within said cylinder, and said coil spring, which surrounds said piercing punch, being disposed within said cylinder, and said plunger being partially slidably disposed within said cylinder, said coil spring being in contact with a lower surface of the flange portion at an one end portion thereof, and being in contact with the step portion at an another end portion thereof, said coil spring being disposed between an inner surface of the cylinder and the outer cylinder surface of the piercing punch body, said one end portion of the coil spring being disposed between the inner surface of the wall portion and said outer cylindrical surface of the piercing punch body, said pad and said cylinder each has one end surface, both of the one end surfaces of said pad and said cylinder being coplanar with each other to be brought into contact with the sheet metal thereon during piercing.

2. A press die for punching a hole in sheet metal, comprising:

an upper die having a pad;

a lower die in an inclined surface of which a piercing die is buried;

a cylinder fitted in the pad;

a piercing punch supported slidably in a punching direction by the cylinder and disposed in face-to-face relation to the piercing die, said piercing punch having a piercing punch body, a sharp projection provided on one end of the piercing punch body for first piercing the sheet metal on the piercing die with a hole in a punching operation of the press die to form a first pierced hole in the sheet metal, and a flange portion united with another end of the piercing punch body, said piercing punch body having an outer cylindrical surface extending in a punching direction, an end surface provided on said one end thereof and extending in a direction perpendicular to the punching direction, and a convexly rounded surface disposed between said outer cylindrical surface and an outer periphery of said end surface, said sharp projection projecting in the punching direction from an inner periphery of said end surface, said piercing punch body being adapted to pierce the sheet metal, in which said first pierced hole is already formed by said sharp projection, to form a second pierced hole in the sheet metal in said punching operation of the press die, said second pierced hole having substantially the same configuration as that of the hole of the piercing die;

a plunger for pressing said flange portion of the piercing punch, the plunger being supported slidably in the punching direction by the cylinder, said plunger having a plunger with one end surface which is in contact with a plate secured to the upper die, a wall portion integrally provided on another end surface of the plunger body, and a hollow portion provided on the another end surface of the plunger body, said hollow portion being defined by the another end surface of the plunger body and an inner surface of the wall portion, being closed by the another end surface of the plunger body at an upper end portion thereof, and opening at a lower end portion thereof, said piercing punch is partially disposed in the hollow portion, said flange portion is disposed in the hollow portion so as to be brought into contact with the another end surface of said plunger body at an upper surface thereof, said cylinder having a larger diameter hole portion in which said plunger is partially disposed, and a smaller diameter hole portion which is communicated with said larger diameter hole portion, and in which said piercing punch is partially disposed, and a step portion disposed between said larger hole portion and said smaller diameter hole portion; and a coil spring disposed between said flange portion of said piercing punch and said step portion of said cylinder in the cylinder to retract the piercing punch and the plunger, the plunger having a head pressed by one of an upper die holder and a plate secured to the upper die holder so as to force out the piercing punch, said piercing punch being slidably disposed within said cylinder, and said coil spring, which surrounds said piercing punch, being disposed within said cylinder, and said plunger being partially slidably disposed within said cylinder, said coil spring being in contact with a lower surface of the flange portion at an one end portion thereof, and being in contact with the step portion at an other end portion thereof, said coil spring being disposed between an inner surface of the cylinder and the outer cylindrical surface of the piercing punch body, said one end portion of the coil spring being disposed between the inner surface of the wall portion and said outer cylindrical surface of the piercing punch body, said pad and said cylinder each has one end surface, both of the one end surfaces of said pad and said cylinder being coplanar with each other to be brought into contact with the sheet metal thereon during piercing.

3. A punch unit for a press die for punching a hole in sheet metal, comprising:

a piercing punch having a piercing punch body with a smaller diameter than a diameter of a hole of a piercing die, a sharp projection provided on one end of the piercing punch body for first piercing the sheet metal on the piercing die in a punching operation of the punch unit to form a first pierced hole in the sheet metal, and a flange portion united with another end of the piercing punch body, said first pierced hole having a smaller diameter than the diameter of the piercing punch body, said piercing punch body having an outer cylindrical surface extending in a punching direction and having said smaller diameter than said diameter of said hole of said piercing die, an end surface provided on said one end thereof opposing the piercing die buried in a lower die and extending in a direction perpendicular to the punching direction, and a convexly rounded surface disposed between said outer cylindrical surface and an outer periphery of said end surface, said sharp projection projecting in the punching direction from an inner periphery of said end surface, said piercing punch body being adapted to pierce the sheet metal, in which said first pierced hole is already formed by said sharp projection, to form a second pierced hole in the sheet metal in said punching operation of the punch unit, said second pierced hole having substantially the same configuration as that of the hole of the piercing die;

a plunger for pressing said piercing punch, said plunger having a plunger body with one end surface which is in contact with a plate secured to an upper die, a wall portion integrally provided on another end surface of the plunger body, and a hollow portion provided on the another end surface of the plunger body, said hollow portion being defined by the another end surface of the plunger body and an inner surface of the wall portion, being closed by the another end surface of the plunger body at an upper end portion thereof, and opening at a lower end portion thereof, said piercing punch is partially disposed in the hollow portion, said flange portion is disposed in the hollow portion so as to be brought into contact with the another end surface of said plunger body at an upper surface thereof, a cylinder adapted to be fitted in a pad of the upper die for supporting said piercing punch and said plunger slidably in a punching direction; said cylinder having a larger diameter hole portion in which said plunger is partially disposed, and a smaller diameter hole portion which is communicated with said larger diameter hole portion, and in which said piercing punch is partially disposed, and a step portion disposed between said larger hole portion and said smaller diameter hole portion; and a coil spring disposed between said flange portion of said piercing punch and said step portion of said cylinder for retracting said piercing punch and said plunger, said piercing punch being slidably disposed within said cylinder, and said coil spring, which surrounds said piercing punch, being disposed within said cylinder, and said plunger being partially slidably disposed within said cylinder, said coil spring being in contact with a lower surface of the flange portion at an one end portion thereof, and being in contact with the step portion at an another end portion thereof, said coil spring being disposed between an inner surface of the cylinder and the outer cylindrical surface of the piercing punch body, said one end portion of the coil spring being disposed between the inner surface of the wall portion and said outer cylindrical surface of the piercing punch body, said pad and said cylinder each has one end surface, both of the one end surfaces of said pad and said cylinder being coplanar with each other to be brought into contact with the sheet metal thereon during piercing.

4. A press die for punching a hole in sheet metal, comprising:

an upper die having a pad;

a lower die in an inclined surface of which a piercing die is buried;

a cylinder fitted in the pad;

a piercing punch supported slidably in a punching direction by the cylinder and disposed in face-to-face relation to the piercing die, said piercing punch having a piercing punch body with a smaller diameter than a diameter of a hole of a piercing die, a sharp projection provided on one end of the piercing punch body for first piercing the sheet metal on the piercing die in a punching operation of the press die to form a first pierced hole in the sheet metal, said first pierced hole having a smaller diameter than the diameter of the piercing punch body, and a flange portion united with another end of the piercing punch body, said piercing punch body having an outer cylindrical surface extending in a punching direction and having said smaller diameter than said diameter of said hole of said piercing die, an end surface provided on said one end thereof and extending in a direction perpendicular to the punching direction, and a convexly rounded surface disposed between said outer cylindrical surface and an outer periphery of said end surface, said sharp projection projecting in the punching direction from an inner periphery of said end surface, said piercing punch body being adapted to pierce the sheet metal, in which said first pierced hole is already formed by said sharp projection, to form a second pierced hole in the sheet metal in said punching operation of the press die, said second pierced hole having substantially the same configuration as that of the hole of the piercing die;

a plunger for pressing said flange portion of the piercing punch, the plunger being supported slidably in the punching direction by the cylinder, said plunger having a plunger body with one end surface which is in contact with a plate secured to the upper die, a wall portion integrally provided on another end surface of the plunger body, and a hollow portion provided on the another end surface of the plunger body, said hollow portion being defined by the another end surface of the plunger body and an inner surface of the wall portion, being closed by the another end surface of the plunger body at an upper end portion thereof, and opening at a lower end portion thereof, said piercing punch is partially disposed in the hollow portion, said flange portion is disposed in the hollow portion so as to be brought into contact with the another end surface of said plunger body at an upper surface thereof, said cylinder having a larger diameter hole portion in which said plunger is partially disposed, and a smaller diameter hole portion which is communicated with said larger diameter hole portion, and in which said piercing punch is partially disposed, and a step portion disposed between said larger hole portion and said smaller diameter hole portion; and a coil spring disposed between said flange portion of said piercing punch and said step portion of said cylinder in the cylinder to retract the piercing punch and the plunger, the plunger having a head pressed by one of an upper die holder and a plate secured to the upper die holder so as to force out the piercing punch, said piercing punch being slidably disposed within said cylinder, and said coil spring, which surrounds said piercing punch, being disposed within said cylinder, and said plunger being partially slidably disposed within said cylinder, said coil spring being in contact with a lower surface of the flange portion at an one end portion thereof, and being in contact with the step portion at an another end portion thereof, said coil spring being disposed between an inner surface of the cylinder and the outer cylindrical surface of the piercing punch body, said one end portion of the coil spring being disposed between the inner surface of the wall portion and said outer cylindrical surface of the piercing punch body, said pad and said cylinder each has one end surface, both of the one end surfaces of said pad and said cylinder being coplanar with each other to be brought into contact with the sheet metal thereon during piercing.

5. A press die for punching a hole in sheet metal, comprising:

an upper die having a pad;

a piercing die;

a cylinder fitted in the pad;

a piercing punch supported slidably in a punching direction by the cylinder and disposed in face-to-face relation to the piercing die, said piercing punch having a piercing punch body, a sharp projection provided on one end of the piercing punch body for first piercing the sheet metal on the piercing die with a hole in a punching operation of the press die to form a first pierced hole in the sheet metal, and a flange portion united with another end of the piercing punch body, said piercing punch body having an outer cylindrical surface extending in a punching direction, an end surface provided on said one end thereof and extending in a direction perpendicular to the punching direction, and a convexly rounded surface disposed between said outer cylindrical surface and an outer periphery of said end surface, said sharp projection projecting in the punching direction from an inner periphery of said end surface, said piercing punch body being adapted to pierce the sheet metal, in which said first pierced hole is already formed by said sharp projection, to form a second pierced hole in the sheet metal in cooperation with the hole of the piercing die in said punching operation of the press die, said second pierced hole having substantially the same configuration as that of the hole of the piercing die;

a plunger for pressing said flange portion of the piercing punch, the plunger being supported slidably in the punching direction by the cylinder, said plunger having a plunger body with one end surface which is in contact with a plate secured to the upper die, a wall portion integrally provided on another end surface of the plunger body, and a hollow portion provided on the another end surface of the plunger body, said hollow portion being defined by the another end surface of the plunger body and an inner surface of the wall portion, being closed by the another end surface of the plunger body at an upper end portion thereof, and opening at a lower end portion thereof, said piercing punch is partially disposed in the hollow portion, said flange portion is disposed in the hollow portion so as to be brought into contact with the another end surface of said plunger body at an upper surface thereof, said cylinder having a larger diameter hole portion in which said plunger is partially disposed, and a smaller diameter hole portion which is communicated with said larger diameter hole portion, and in which said piercing punch is partially disposed and a step portion disposed between said larger hole portion and said smaller diameter hole portion; and a coil spring disposed between said flange portion of said piercing punch and said step portion of said cylinder in the cylinder to retract the piercing punch and the plunger, the plunger having a head pressed by one of an upper die holder and a plate secured to the upper die holder so as to force out the piercing punch, said piercing punch being slidably disposed within said cylinder, and said coil spring, which surrounds said piercing punch, being disposed within said cylinder, and said plunger being partially slidably disposed within said cylinder, said coil spring being in contact with a lower surface of the flange portion at an one end portion thereof, and being in contact with the step portion at an another end portion thereof, said coil spring being disposed between an inner surface of the cylinder and the outer cylindrical surface of the piercing punch body, said one end portion of the coil spring being disposed between the inner surface of the wall portion and said outer cylindrical surface of the piercing punch body, said pad and said cylinder each has one end surface, both of the one end surfaces of said pad and said cylinder being coplanar with each other to be brought into contact with the sheet metal thereon during piercing.

6. A press die for punching a hole in sheet metal, comprising:

an upper die having a pad;

a piercing die;

a cylinder fitted in the pad;

a piercing punch supported slidably in a punching direction by the cylinder and disposed in face-to-face relation to the piercing die, said piercing punch having a piercing punch body with a smaller diameter than a diameter of a hole of a piercing die, a sharp projection provided on one end of the piercing punch body for first piercing the sheet metal on the piercing die in a punching operation of the press die to form a first pierced hole in the sheet metal, said first pierced hole having a smaller diameter than the diameter of the piercing punch body, and a flange portion united with another end of the piercing punch body, said piercing punch body having an outer cylindrical surface extending in a punching direction and having said smaller diameter than said diameter of said hole of said piercing die, an end surface provided on said one end thereof and extending in a direction perpendicular to the punching direction, and a convexly rounded surface disposed between said outer cylindrical surface and an outer periphery of said end surface, said sharp projection projecting in the punching direction from an inner periphery of said end surface, said piercing punch body being adapted to pierce the sheet metal, in which said first pierced hole is already formed by said sharp projection, to form a second pierced hole in the sheet metal in cooperation with the hole of the piercing die in said punching operation of the press die, said second pierced hole having substantially the same configuration as that of the hole of the piercing die;

a plunger for pressing said flange portion of the piercing punch, the plunger being supported slidably in the punching direction by the cylinder, said plunger having plunger body with one end surface which is in contact with a plate secured to the upper die, a wall portion integrally provided on another end surface of the plunger body, and a hollow portion provided on the another end surface of the plunger body, said hollow portion being defined by the another end surface of the plunger body and an inner surface of the wall portion, being closed by the another end surface of the plunger body at an upper end portion thereof, and opening at a lower end portion thereof, said piercing punch is partially disposed in the hollow portion, said flange portion is disposed in the hollow portion so as to be brought into contact with the another end surface of said plunger body at an upper surface thereof, said cylinder having a larger diameter hole portion in which said plunger is partially disposed, and a smaller diameter hole portion which is communicated with said larger diameter hole portion, and in which said piercing punch is partially disposed, and a step portion disposed between said larger hole portion and said smaller diameter hole portion; and a coil spring disposed between said flange portion of said piercing punch and said step portion of said cylinder in the cylinder to retract the piercing punch and the plunger, the plunger having a head pressed by one of an upper die holder and a plate secured to the upper die holder so as to force out the piercing punch, said piercing punch being slidably disposed within said cylinder, and said coil spring, which surrounds said piercing punch, being disposed within said cylinder, and said plunger being partially slidably disposed within said cylinder, said coil spring being in contact with a lower surface of the flange portion at an one end portion thereof, and being in contact with the step portion at an another end portion thereof, said coil spring being disposed between an inner surface of the cylinder and the outer cylindrical surface of the piercing punch body, said one end portion of the coil spring being disposed between the inner surface of the wall portion and said outer cylindrical surface of the piercing punch body, said pad and said cylinder each has one end surface, both of the one end surfaces of said pad and said cylinder being coplanar with each other to be brought into contact with the sheet metal thereon during piercing.

* * * * *